US008561724B2

(12) United States Patent
Xu

(10) Patent No.: US 8,561,724 B2
(45) Date of Patent: Oct. 22, 2013

(54) EXPANDING MILL HAVING CAMMING SLEEVE FOR EXTENDING CUTTING BLADE

(75) Inventor: Ying Qing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 338 days.

(21) Appl. No.: 12/930,948

(22) Filed: Jan. 20, 2011

(65) Prior Publication Data

US 2012/0186823 A1 Jul. 26, 2012

(51) Int. Cl.
*E21B 7/28* (2006.01)

(52) U.S. Cl.
USPC ..... 175/273; 175/279; 175/286

(58) Field of Classification Search
USPC ..... 175/273, 279, 286, 406
See application file for complete search history.

(56) References Cited

U.S. PATENT DOCUMENTS

| | | | | |
|---|---|---|---|---|
| 5,407,011 | A | 4/1995 | Layton | |
| 6,615,933 | B1 * | 9/2003 | Eddison | 175/284 |
| 7,591,314 | B2 | 9/2009 | Sonnier et al. | |
| 2002/0070052 | A1 * | 6/2002 | Armell et al. | 175/273 |
| 2004/0222022 | A1 * | 11/2004 | Nevlud et al. | 175/57 |

FOREIGN PATENT DOCUMENTS

EP 1405983 A2 4/2004

OTHER PUBLICATIONS

Notification of Transmittal of the International Search Report and the Written Opinion of the International Searching Authority, or the Declaration, Sep. 12, 2012, pp. 1-2, PCT/US2011/065788, Korean Intellectual Property Office.
International Search Report, Sep. 12, 2012, pp. 1-4, PCT/US2011/065788, Korean Intellectual Property Office.
Written Opinion of the International Searching Authority, Sep. 12, 2012, pp. 1-5, PCT/US2011/065788, Korean Intellectual Property Office.
Baker Hughes Incorporated, Fishing Services, 2001, cover page, p. 66, and back page, Baker Hughes Incorporated, Houston, Texas, USA.

* cited by examiner

*Primary Examiner* — Yong-Suk (Philip) Ro
(74) *Attorney, Agent, or Firm* — Greenberg Traurig LLP; Anthony F. Matheny

(57) ABSTRACT

Downhole cutting tools comprise a mandrel, a housing, a sleeve and a cutting blade. The mandrel comprises an inner wall surface defining a bore, and an outer wall surface. The housing is secured to the outer wall surface of the mandrel and comprises an opening. The sleeve is engaged with the outer wall surface of the mandrel. The sleeve comprises a profile that is operatively associated with a profile of the cutting blade such that movement of the sleeve causes the profile of the piston to slide along the profile of the cutting blade. In so doing, the cutting blade is radially extended outward through the opening in the housing to abrade an object located outside the housing. Movement of the sleeve can be achieved by pumping fluid down a bore in the mandrel to slide the sleeve long the outer wall surface of the mandrel.

18 Claims, 3 Drawing Sheets

EXPANDING MILL HAVING CAMMING SLEEVE FOR EXTENDING CUTTING BLADE

BACKGROUND

1. Field of Invention

The invention is directed to downhole milling tools utilized in oil and gas wells to abrade, cut, or mill an object within the well and, in particular, to downhole cutting tools having a blade that is retracted during run-in and extended radially outward for cutting, abrading, or milling.

2. Description of Art

In the drilling, completion, and workover of oil and gas wells, it is common to perform work downhole in the wellbore with a tool that has some sort of cutting profile interfacing with a downhole structure. Examples would be milling a downhole metal object with a milling tool or cutting through a tubular with a cutting or milling tool. To facilitate these operations, cutting elements are disposed on the downhole cutting tool. In one type of milling tool, the cutting elements are disposed on blades that can be disposed in a retracted position and an extended position. In certain of these embodiments, the blades are extended by increasing the pressure across the tool. Upon reduction of the pressure, such as after the milling operation has been completed, the blades are moved back to their retracted position so that the tool can be retrieved from the well.

SUMMARY OF INVENTION

Broadly, the invention is directed to cutting, abrading, or milling tools used to cut or abrade an object within a wellbore. The cutting tool includes at least one cutting blade having a retracted position and a plurality of extended positions. The blade is operatively associated with a sleeve that includes a profile disposed on its outer wall surface. Another profile is disposed on an inner wall surface of the cutting blade such that when the sleeve is moved in a certain direction, the engagement of the two profiles causes the cutting blade to move radially outward so that it can engage and cut the object within the well, or the well itself. The term "object" encompasses any physical structure that may be disposed within a well, for example, another tool that is stuck within the well, a bridge plug, the well tubing, the well casing, the well formation, or the like.

In one particular embodiment, the tool comprises a mandrel having a bore disposed therein and the sleeve is a piston in sliding engagement with the outer wall surface of the mandrel. Disposed around the periphery of the outer wall surface of the piston is a profile for receiving a profile on a cutting blade. The profile on the piston and the profile on the cutting blade are operatively associated with each other such that movement of the piston in a certain direction will force the cutting blade to move radially outward from the longitudinal axis of the tool.

Figure 1:
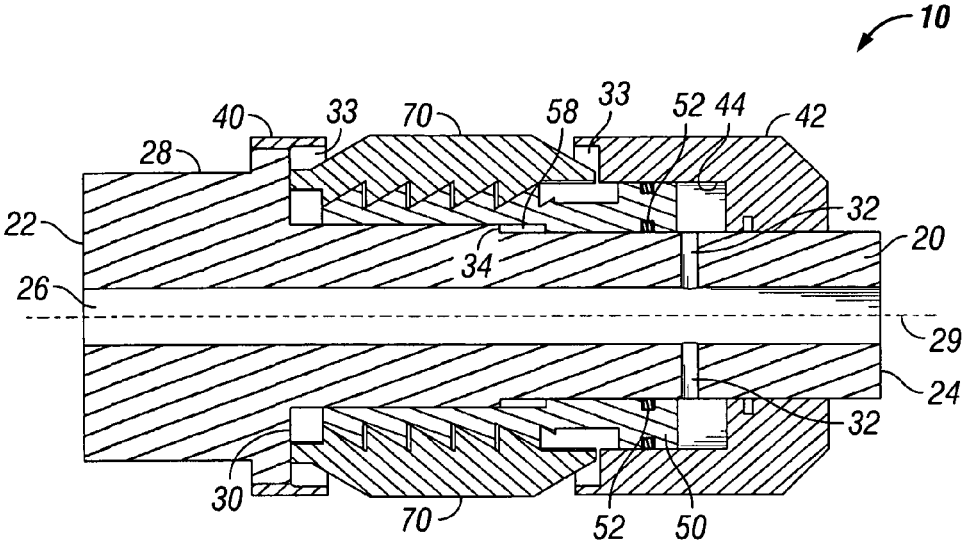
FIG. 1 is a cross-sectional view of one specific embodiment of a downhole cutting tool disclosed herein shown in its run-in position.

While the invention will be described in connection with the preferred embodiments, it will be understood that it is not intended to limit the invention to these embodiments. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-6, downhole cutting tool 10 comprises mandrel 20 having upper end 22, lower end 24, and bore 26 disposed longitudinally therein. Mandrel 20 is adapted at upper end 22 to be connected to drill or work string (not shown) such as through threads (not shown). Mandrel 20 includes outer wall surface 28, longitudinal axis 29, shoulder 30 for supporting cutting blade 70 when tool 10 is in the run-in position (FIG. 1), and ports 32 disposed through outer wall surface 28 and in fluid communication with bore 26. In the embodiment of FIGS. 1-6, outer wall surface 28 also includes lower shoulder 34.

Secured to outer wall surface 28 of mandrel 20 is upper gage ring 40 and lower gage ring 42. Upper gage ring 40 and lower gage ring 42 can be secured to mandrel 20 through any method or device know in the art, such as threads (not shown). Upper gage ring 40 and lower gage ring 42, when disposed on outer wall surface 28 of mandrel 20, provide housing 33 within which piston 50 and in which the cutting blade 70 is fully disposed during run-in (FIG. 1) and partially disposed during cutting operations (FIG. 2).

Piston 50 is in sliding engagement with outer wall surface 28 of mandrel 20 and inner wall surface 44 of lower gage ring. Seals 52 are disposed on piston 50 to reduce the likelihood of leakage occurring between piston 50 and inner wall surface 44 of lower gage ring 42 and between piston 50 and outer wall surface 28 of mandrel 20. In the embodiment shown in FIGS. 1-6, piston 50 is a sleeve piston and includes a piston shoulder 54 disposed on an inner wall surface 56 of piston 50. Piston shoulder 54 and inner wall surface 56 of piston 50 are shown best in FIG. 5. Piston shoulder 54 facilitates formation of chamber 58 by outer wall surface 28 of mandrel 20, inner wall surface 56 of piston 50, and lower shoulder 34 disposed on outer wall surface 28 of mandrel 20.

Figure 4:
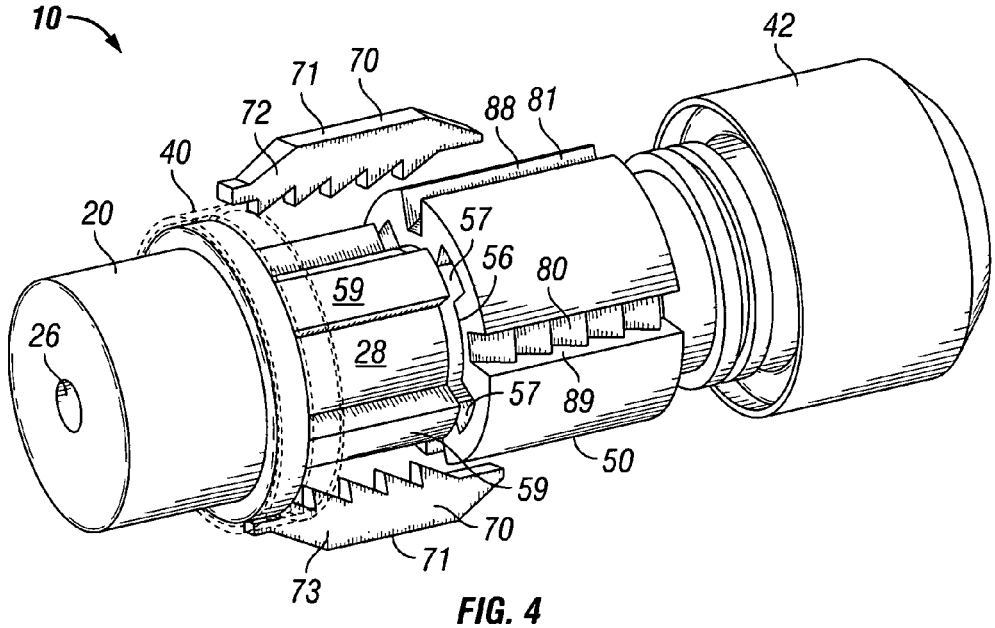
FIG. 4 is a partial exploded perspective view of the downhole cutting tool of FIG. 1.
Figure 5:
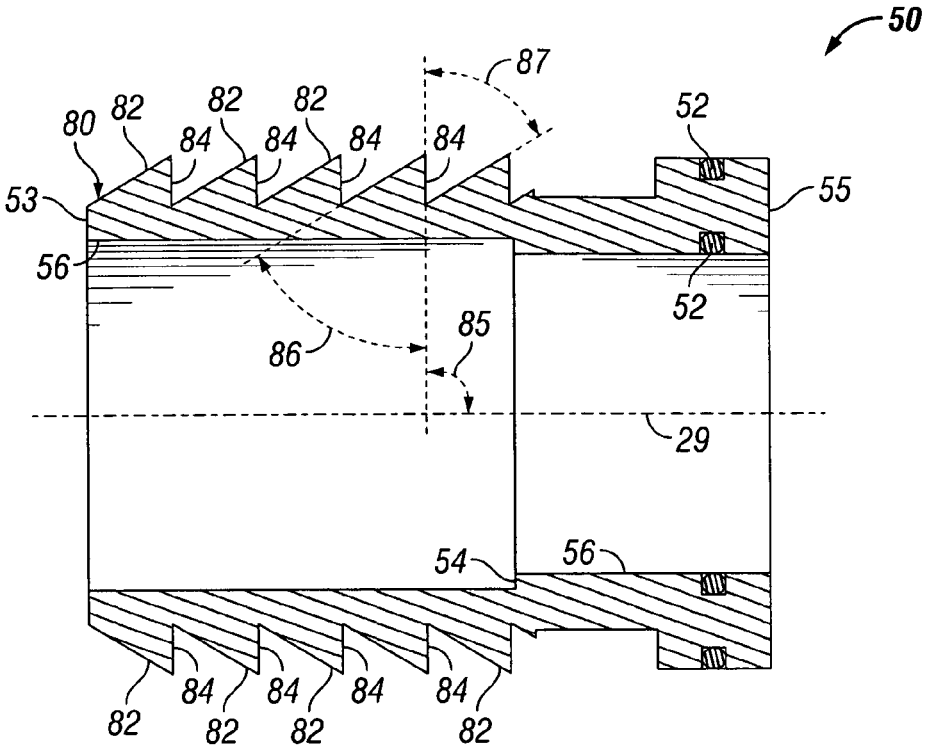
FIG. 5 is a cross-sectional view of the piston of the downhole cutting tool of FIG. 1.
Figure 6:
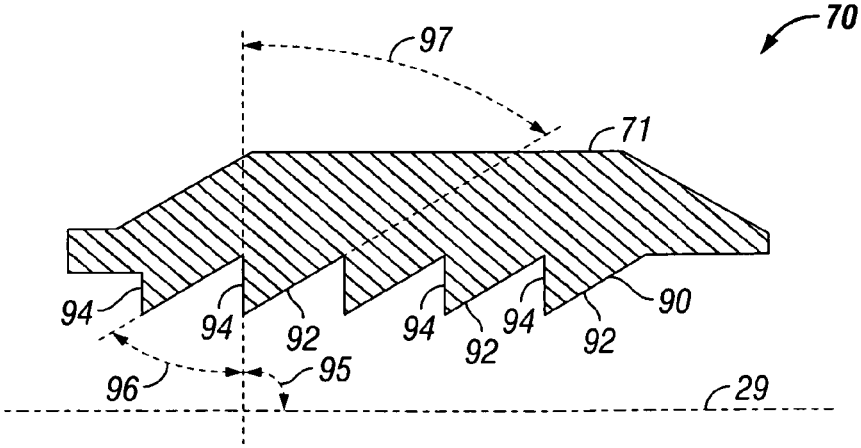
FIG. 6 is a cross-sectional view of a blade of the downhole cutting tool of FIG. 1.

As shown in FIG. 4, inner wall surface 56 of piston includes one or more longitudinal piston slots 57 which are capable of receiving torque key 59 disposed on outer wall surface 28 of mandrel 20 to facilitate rotation of piston 50 and, thus, rotation of cutting blades 70.

Figure 2:
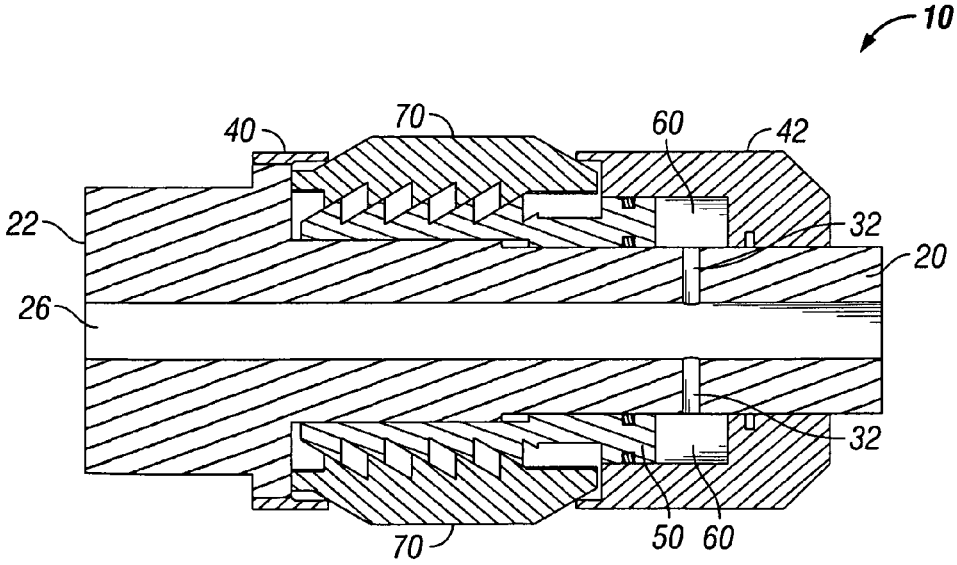
FIG. 2 is cross-sectional view of the downhole cutting tool of FIG. 1 shown in an extended position.
Figure 3:
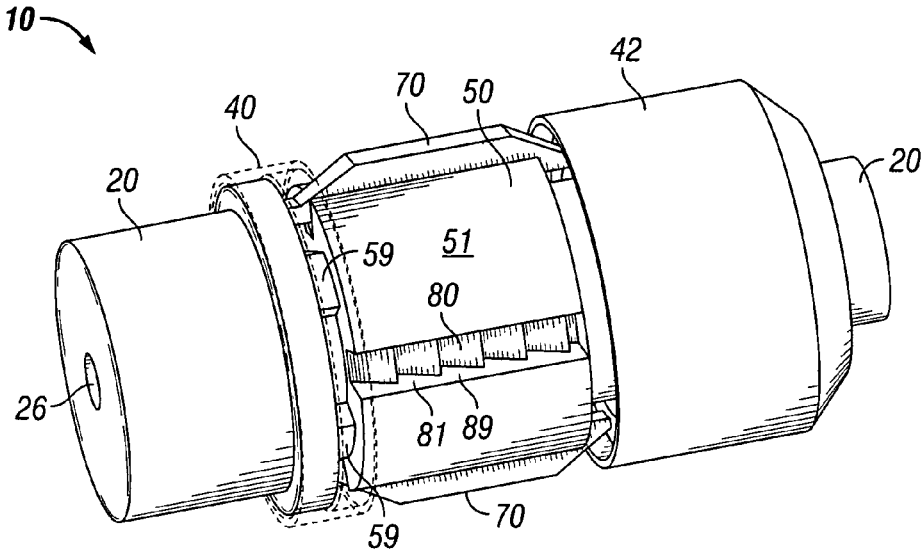
FIG. 3 is a partial perspective view of the downhole cutting tool of FIG. 1 shown in its run-in position.

As illustrated in FIGS. 1-2, piston 50 is disposed relative to lower gage 42 to provide chamber 60 formed by inner wall surface 44 of lower gage ring 42, piston 50, and outer wall surface 28 of mandrel 20. Chamber 60 is in fluid communication with ports 32, which are in fluid communication with bore 26.

Tool 10 can include a single cutting blade 70, or a plurality of cutting blades 70. In one particular embodiment, tool 10 includes two cutting blades. In another specific embodiment, tool 10 includes three cutting blades. In still another embodiment, tool 10 includes four cutting blades. In other embodiments, tool 10 can include five or more cutting blades.

In addition, in embodiments having multiple cutting blades 70, the cutting blades 70 may be disposed at any interval around piston 50 that is desired or necessary to provide suitable cutting capability. In one embodiment, each cutting blade 70 is disposed at a regular interval around piston 50, e.g., two cutting blades 70 can be disposed at 180 degree intervals from one another, three cutting blades 70 can be disposed at 120 degree intervals from one another, four cutting blades 70 can be disposed at 90 degree intervals from one another, five cutting blades 70 can be disposed at 72 degree intervals from one another, six cutting blades 70 can be disposed at 60 degree intervals from one another, and the like. In other embodiments, each cutting blade 70 is disposed at irregular intervals around piston 50, e.g., two cutting blades 70 can be disposed at a 120 degree interval in one direction and a 240 degree interval in another direction.

Although not completely shown in FIGS. 1-6, tool 10 of FIGS. 1-6 includes four cutting blades 70 disposed at 90 degree intervals from each other. Due to the views of the Figures, one of the cutting blades cannot be seen and, in FIGS. 3-4 one of the cutting blades has been removed to better illustrate the piston profile associated with that cutting blade.

Regardless of the number or location of the cutting blade (s), each cutting blade 70 comprises one or more cutting surfaces. As shown in the embodiments of FIGS. 1-6, each cutting blade 70 includes cutting surfaces 71, 72, 73 upon which cutting elements (not shown) can be secured. Cutting elements are known in the art and include carbide buttons, hardfacing, and any other material known in the art used to facilitate cutting or abrading.

Piston 50 is operatively associated with one or more cutting blades 70 so that cutting blades 70 are disposed within housing 33 during run-in of the tool 10, as shown in FIG. 1, and so that cutting blades 70 are moved radially outward from the longitudinal axis of tool 10 when piston 50 is moved upward (to the left in the Figures) as shown in FIG. 2. In the particular embodiment shown in FIGS. 1-6, piston 50 and cutting blades 70 are operatively associated with each other through piston profile 80 and cutting blade profile 90. As shown in FIGS. 1-6, piston profile 80 comprises multiple cam ramps 82 and cam support walls 84 defining angles 85, 86, 87 and cutting blade profile 90 is reciprocally-shaped with piston profile 80 comprising multiple cam ramps 92 and cam support walls 94 defining angles 95, 96, 97. In this embodiment, cutting blade 90 is moved radially outward by sliding piston 50 upward (toward the left in FIGS. 1-2) causing cutting blade cam ramps 92 to slide along piston cam ramps 82 until cutting blades 70 are disposed outside housing 33. In this position (shown in FIG. 2), cutting blades 70 can cut, abrade, or mill an object disposed within the well (not shown). Thereafter, piston 50 can be moved downward (toward the right in FIGS. 1-2), causing cutting blade cam ramps 92 to slide along piston cam ramps 82 until cutting blades 70 are moved back within housing 33.

Although five piston cam ramps 82 and five cutting blade cam ramps 92 are shown in the embodiment of FIGS. 1-6, it is to be understood that more or less piston cam ramps 82 and more or less blade cam ramps 92 may be included. In addition, although each of the piston cam ramps 82 are shown in FIGS. 1-6 to be identical in shape to each other, and identical in shape to each of the cutting blade cam ramps 92, it is to be understood that each of piston cam ramps 82 may have different shapes, e.g., each of angles 85, 86, and 87 may be different among each of piston cam ramps 82. Similarly, each of cutting blade cam ramps 92 may have different shapes, e.g., each of angles 95, 96, and 97 may be different among each of cutting blade cam ramps 92.

In one particular embodiment, all of piston cam ramps 82 are identical to each other, all of cutting blade cam ramps 92 are identical to each other, angles 85 are in the range from 0 degrees to 90 degrees, angles 86 are in the range from 0 degrees to 90 degrees, angles 87 are in the range from 0 degrees to 90 degrees, angles 95 are in the range from 0 degrees to 90 degrees, angles 96 are in the range from 0 degrees to 90 degrees, and angles 97 are in the range from 15 degrees to 90 degrees. In another specific embodiment, all of piston cam ramps 82 are identical to each other, all of cutting blade cam ramps 92 are identical to each other, angles 85 are each approximately 90 degrees, angles 86 are each approximately 60 degrees, angles 87 are each approximately 60 degrees, angles 95 are each approximately 90 degrees, angles 96 are each approximately 60 degrees, and angles 97 are each approximately 60 degrees.

In addition, in the embodiment shown in FIGS. 1-6, piston profile 80 is disposed in a recess or longitudinal groove 81 disposed on outer wall surface 51 of piston 50. Groove 81 provides side walls 88, 89 that provide support to cutting blades 70 during their extension and engagement with an object or objects to be cut within the well.

In one specific embodiment, the piston profile 80 and cutting blade profile 90 provide support for the majority of the length, i.e., over 50% of the length, of the cutting blade 70 when in its extended positions, e.g., the position shown in FIG. 2.

In operation, tool 10 is secured to a work string (not shown) and is run-in to the wellbore to the desired depth. During run-in, tool 10 is disposed in the position shown in FIG. 1, i.e., the run-in position. Upon reaching the desired location in the wellbore, fluid, such as hydraulic fluid, is pumped down the work string and into bore 26 of tool 10. The fluid flow through ports 32 into chamber 60 causing an increase in pressure within chamber 60 which acts on lower end 55 of piston 50 to force piston 50 upward, i.e., toward the left in FIGS. 1-2. As a result of piston 50 moving upward, cutting blades 70 are moved radially outward to engage an object disposed in the well (not shown) due to the camming action of piston profile 80 acting on cutting blade profile 90. In the particular embodiment of FIGS. 1-6, the camming action is caused by cutting blade cam ramps 92 sliding along piston cam ramps 82 to the position shown in FIG. 2. Upon being extended, cutting blade 70 is supported along its longitudinal length by piston profile 80 and by side walls 88, 89 of groove 81 to facilitate cutting of the object.

After extension of cutting blades 70, the work string (not shown) is rotated. Rotation of the work string results in torque keys 59 rotating piston 50 and, therefore, cutting blades 70. Rotation of cutting blades 70 results in the object within the wellbore being cut or abraded. In embodiments in which cutting blades 70 have cutting surfaces 72 and 73, rotation in either direction, i.e., clockwise or counterclockwise, results in cutting or abrasion of the object. In addition, the presence of cutting surface 71 can also facilitate cutting or abrasion of the object regardless of which direction tool 10 is rotated.

Upon completion of the cutting or abrasion of the object, fluid pressure within bore 26 of tool 10 is reduced. As result, piston 50 is returned to toward its run-in position (FIG. 1) by a force acting on piston 50. The force acting on piston 50 to return piston 50 toward its run-in position may be due to one or more of hydrostatic pressure within the wellbore acting on piston 50, atmospheric pressure within chamber 58 acting on piston 50, resistance of the wellbore formation, wellbore casing, or object being cut acting on cutting blades 70, which in turn acts on piston 50, and/or the inclusion of a return member such as a spring (not shown) disposed above lower end 53 of piston 50.

In moving piston 50 toward the run-in position, cutting blades 70 are retracted into housing 33. Upon being returned to the run-in position, tool 10 can be moved within wellbore to remove tool 10 from the wellbore or to move tool 10 to another location for continued cutting and abrasion by repeating the steps described above.

It is to be understood that the invention is not limited to the exact details of construction, operation, exact materials, or embodiments shown and described, as modifications and equivalents will be apparent to one skilled in the art. For example, piston profile and cutting blade profile are not required to be reciprocally-shaped as shown in the embodiment of FIGS. 1-6. To the contrary, piston profile and cutting blade profile only need to be able to engage one another so that the cutting blade can be extended and retracted. Further, the cross-sectional shape of the cutting blades is not critical. In addition, modification of the angles 85, 86, 87, 95, 96, 97, as well as the height of support walls 84 and 94 can be done to provide the desired or necessary extension and support of the cutting blades. Moreover, to the extent that the terms well or wellbore are argued to be limiting in their definition, it is to be understood that these terms should not be limited and these terms as used herein include, but are not limited to, cased wellbores, open-hole wellbores cut into a formation, and boreholes. Additionally, the terms cutting, milling, abrading are to be understood has having coextensive definitions. Accordingly, the invention is therefore to be limited only by the scope of the appended claims.

What is claimed is:

1. A downhole cutting tool comprising:

a mandrel;

a sleeve disposed on an outer wall surface of the mandrel, the sleeve comprising a sleeve camming profile disposed on an outer wall surface of the sleeve, the sleeve camming profile having a plurality of cam ramps and a plurality of cam support walls;

a cutting blade operatively associated with the sleeve such that movement of the sleeve causes the sleeve camming profile to radially extend the cutting blade outward, wherein the sleeve is a piston and wherein the mandrel further comprises a bore and a port, the port being in fluid communication with the bore, the port being in fluid communication with a chamber for receiving fluid and for actuating the piston.

2. The downhole cutting tool of claim 1, wherein at least one of the plurality of cam ramps being disposed at a first cam ramp angle relative to a longitudinal axis of the mandrel, the first cam ramp angle being in the range from 0 degrees to 90 degrees.

3. The downhole cutting tool of claim 2, wherein the first cam ramp angle is between approximately 15 degrees and approximately 75 degrees.

4. The downhole cutting tool of claim 3, wherein at least one of the plurality of cam support walls is disposed at a first cam support wall angle relative to the longitudinal axis, the first cam support wall angle being in the range from approximately 75 degrees to approximately 90 degrees.

5. The downhole cutting tool of claim 1, wherein the cutting blade includes a cutting blade profile for operatively engaging the sleeve camming profile.

6. The downhole cutting tool of claim 5, wherein the cutting blade profile comprises a plurality of cutting blade ramps and a plurality of cutting blade support walls, at least one of the plurality of cutting blade ramps being disposed at a first cutting blade ramp angle relative to a longitudinal axis of the mandrel, the first cutting blade ramp angle being in the range from 0 degrees to 90 degrees.

7. The downhole cutting tool of claim 6, wherein the first cutting blade ramp angle is between approximately 15 degrees and approximately 75 degrees.

8. The downhole cutting tool of claim 7, wherein at least one of the plurality of cutting blade support walls is disposed at a first cutting blade support wall angle relative to the longitudinal axis, the first cutting blade support wall angle being in the range from approximately 75 degrees to approximately 90 degrees.

9. The downhole tool of claim 1, wherein the piston comprises a longitudinal groove comprising a first side wall, a second side wall, and a bottom wall, the bottom wall comprising the sleeve camming profile.

10. A downhole cutting tool comprising:

a mandrel comprising an inner wall surface defining a bore, an outer wall surface and at least one port disposed through the outer wall surface of the mandrel and in fluid communication with the bore;

a housing secured to the outer wall surface of the mandrel, the housing having an opening;

a piston in sliding engagement along an outer wall surface of the mandrel and an inner wall surface of the housing, the piston and housing defining a chamber in fluid communication the port, the piston comprising a first piston camming profile disposed on an outer wall surface of the piston;

a cutting blade having a first cutting blade profile disposed on an inner wall surface of the cutting blade, the first cutting blade profile being operatively associated with the first piston camming profile so that movement of the piston along the outer wall surface of the mandrel causes outward radial extension of the cutting blade.

11. The downhole cutting tool of claim 10, wherein the piston camming profile comprises a first piston cam ramp and a first piston cam support wall, the first piston cam ramp being disposed at a first piston cam ramp angle relative to a longitudinal axis of the mandrel.

12. The downhole cutting tool of claim 11, wherein the cutting blade profile comprises a first cutting blade ramp and a first cutting blade support wall, the first cutting blade ramp being disposed at a first cutting blade ramp angle relative to a longitudinal axis of the mandrel, the first piston cam ramp being in sliding engagement with the first cutting blade ramp.

13. The downhole cutting tool of claim 12, wherein the first piston cam ramp angle is identical to the first cutting blade ramp angle.

14. The downhole cutting tool of claim 13, where in the cutting blade profile further comprises a second cutting blade ramp and a second cutting blade support wall, the second cutting blade ramp being disposed at a second cutting blade ramp angle relative to the longitudinal axis of the mandrel.

15. The downhole cutting tool of claim 14, where in the piston camming profile further comprises a second piston cam ramp and a second piston cam support wall, the second piston cam ramp being disposed at a second piston cam ramp angle relative to the longitudinal axis of the mandrel, the second piston cam ramp being in sliding engagement with the second cutting blade ramp.

16. The downhole cutting tool of claim 15, wherein the housing comprises upper and lower gage rings secured to the mandrel.

17. A method of cutting an object disposed in a wellbore, the method comprising the steps of:

(a) providing a downhole cutting tool having a mandrel, a piston disposed on an outer wall surface of the mandrel, the piston comprising a piston camming profile disposed on an outer wall surface of the piston, and a cutting blade comprising a run-in position, a cutting position, and a cutting blade profile operatively associated with the piston camming profile such that movement of the piston causes the piston camming profile to slide along the cutting blade profile to radially extend the cutting blade outward;

(b) running the downhole cutting tool within a well with the cutting blade in the run-in position;

(c) extending the cutting blade radially outward to the cutting position by moving the piston causing the piston camming profile of the piston to slide along the cutting blade profile; and (d) with the cutting blade in the cutting position, rotating the downhole cutting tool to abrade an object disposed in the wellbore, wherein the step (c) is performed by pumping fluid down a bore of the mandrel and into a chamber of the downhole cutting tool to force the piston along the outer wall surface of the mandrel.

18. The method of claim 17, further comprising a step of retracting the cutting blade to the run-in position by sliding the piston camming profile along the cutting blade profile.

* * * * *